US005615507A

United States Patent [19]

French

[11] Patent Number: 5,615,507

[45] Date of Patent: Apr. 1, 1997

[54] FIRE CONTROL MECHANISM FOR A FIREARM

[75] Inventor: Kendrick L. French, Lebanon, Me.

[73] Assignee: Thompson Intellectual Properties, Ltd., Rochester, N.H.

[21] Appl. No.: 483,197

[22] Filed: Jun. 7, 1995

[51] Int. Cl.[6] ..... F41A 17/00

[52] U.S. Cl. ..... 42/69.02; 42/70.05; 89/144; 89/148

[58] Field of Search ..... 42/70.05, 69.02; 89/144, 148

[56] References Cited

U.S. PATENT DOCUMENTS

| | | | |
|---|---|---|---|
| 600,337 | 3/1898 | Richardson | 42/70.05 |
| 609,233 | 8/1898 | Houghton | 42/70.05 |
| 811,807 | 2/1906 | Wesson | 42/70.05 |
| 835,380 | 11/1906 | Wesson et al. | 42/70.05 |
| 954,657 | 4/1910 | Stockwell | 42/70.05 |
| 2,514,981 | 7/1950 | Walker et al. | 42/70.01 |
| 3,988,848 | 11/1976 | Chatigny | 42/66 |
| 4,854,065 | 8/1989 | French et al. | 42/65 |
| 4,870,770 | 10/1989 | Forbes | 42/70.01 |
| 4,908,970 | 3/1990 | Bell | 42/69.02 |
| 5,109,622 | 5/1992 | Echeberria | 42/69.02 |

*Primary Examiner*—J. Woodrow Eldred

*Attorney, Agent, or Firm*—Blodgett & Blodgett, P.C.

[57] ABSTRACT

A locking mechanism for a firearm a striker which is slidably mounted in the breach end of the barrel of the firearm for movement between a rearward cock position and a forward firing position. The striker is biased toward the firing position and is moved to the cock position against the bias by an actuator. The fire control mechanism includes a trigger housing which is fixed to the breach end of the barrel and a trigger which is mounted for pivoting movement between a cocked position and a firing position. The sear is also mounted on a housing for pivoting movement between a striker holding position and a striker release position. The sear is effective to hold the striker in its cocked position and is, in turn, held in its regular holding position by the trigger. When the trigger is moved to its firing position, the sear is no longer supportive by the trigger and no longer able to hold the striker in its cocked position against the biasing means for the striker, which results in the movement of the striker toward its firing position. A locking mechanism is mounted on a trigger housing for selective actuation between an active state and an inactive state. When the locking mechanism is in its active state, the sears is prevented it from moving to its striker release position when the trigger is moved to its firing position. When the locking mechanism is in its inactive state, the sear is free to move to its striker release position when the trigger is moved to its firing position.

8 Claims, 5 Drawing Sheets

FIRE CONTROL MECHANISM FOR A FIREARM

BACKGROUND OF THE INVENTION

The present invention relates generally to a firearm in which firing or discharge of the firearm is initiated by the release of a spring loaded striker, which release is controlled by a trigger mechanism. The invention is particularly directed to a firearm in which the striker is a bolt which is slidably mounted in the breech end of a barrel for sliding movement between a rearward cocked position and a forward firing position. The bolt is biased toward the firing position by a first relatively strong spring. The bolt has a notch which is engaged by a sear for holding the bolt in the cocked position. The sear is mounted for movement between a holding position and a release position. The sear is biased toward the holding position by a second relatively weak spring and is biased toward the release position by the first relatively strong spring, acting through the striker or bolt. Since the first spring is considerably stronger than the second spring, the sear is normally biased toward its release position. The sear is prevented from moving to its release position by a trigger mechanism. Actuation of the trigger mechanism releases the sear which, in turn, releases the striker or bolt toward the discharge position.

In order to prevent accidental firing of the firearm, many firearms are provided with locking means to prevent the trigger from being pulled or actuated. Locking devices which act directly on the trigger mechanism have had limited success. Although the trigger can be effectively blocked from being actuated, a jarring of the firearm can release the sear. Since the striker or bolt is retained in the cocked position directly by the sear, an accidental release of the sear will result in the accidental firing of the firearm. This and other difficulties experienced with prior art locking devices for firearms have been obviated by the present invention.

It is, therefore, a principal object of the present invention to provide a fire control mechanism for a firearm which includes a locking mechanism that acts directly on the sear to selectively maintain the sear in its striker holding position.

Another object of the present invention is the provision of a fire control mechanism for a firearm which provides a positive physical blocking of the sear in the cocked position of the sear to prevent the sear from moving to its striker release position.

A further object of the invention is the provision of a fire control mechanism for a firearm wherein the sear can be completely disengaged from the trigger so that the movement of the trigger to its firing position has no effect on the discharge of the firearm when the sear is disengaged from the trigger.

It is another object of the present invention to provide a fire control mechanism for a firearm which includes a locking mechanism which is located for convenient actuation by the user to either of its locked or unlocked positions and is protected against movement to its unlocked position.

With these and other objects in view, as will be apparent to those skilled in the art, the invention resides in the combination of parts set forth in the specification and covered by the claims appended hereto.

SUMMARY OF THE INVENTION

The invention consists of a fire control mechanism for a firearm having a striker which is slidably mounted in the breech end of the barrel of the firearm for movement between a rearward cocked position and a forward firing position. The striker is biased toward the firing position and is moved to the cocked position against the bias by an actuator. The fire control mechanism comprises a trigger housing which is fixed to the breech end of the barrel and a trigger which is mounted for pivoting movement between a cocked position and a firing position. The sear is also mounted on a housing for pivoting movement between a striker holding position and a striker release position. The sear is effective to hold the striker in its cocked position and is, in turn, held in its regular holding position by the trigger. When the trigger is moved to its firing position, the sear is no longer supported by the trigger and is no longer able to hold the striker in its cocked position against the biasing means for the striker. This results in the movement of the striker toward its firing position. A locking mechanism is mounted on a trigger housing for selective actuation between an active state and an inactive state. When the locking mechanism is in its active state, the sear is prevented from moving to its striker release position when the trigger is moved to its firing position. When the locking mechanism is in its inactive state, the sear is free to move to its striker release position when the trigger is moved to its firing position.

BRIEF DESCRIPTION OF THE DRAWINGS

The character of the invention, however, may be best understood by reference to one of the structural forms as illustrated by the accompanying drawings, in which.

DESCRIPTION OF THE PREFERRED EMBODIMENT

Figure 1:
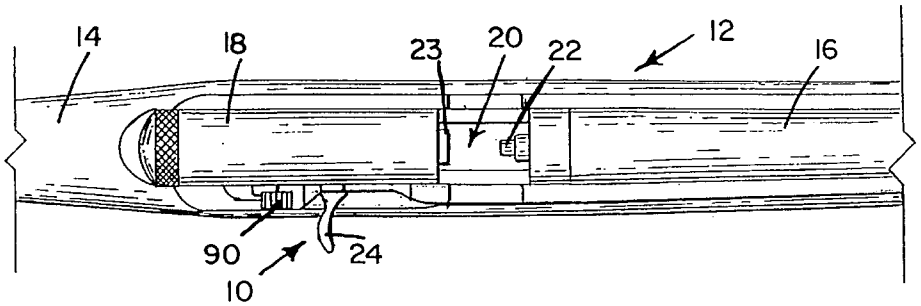
FIG. 1 is a top plan view of the breech portion of a firearm which contains the fire control mechanism of the present invention.
Figure 2:
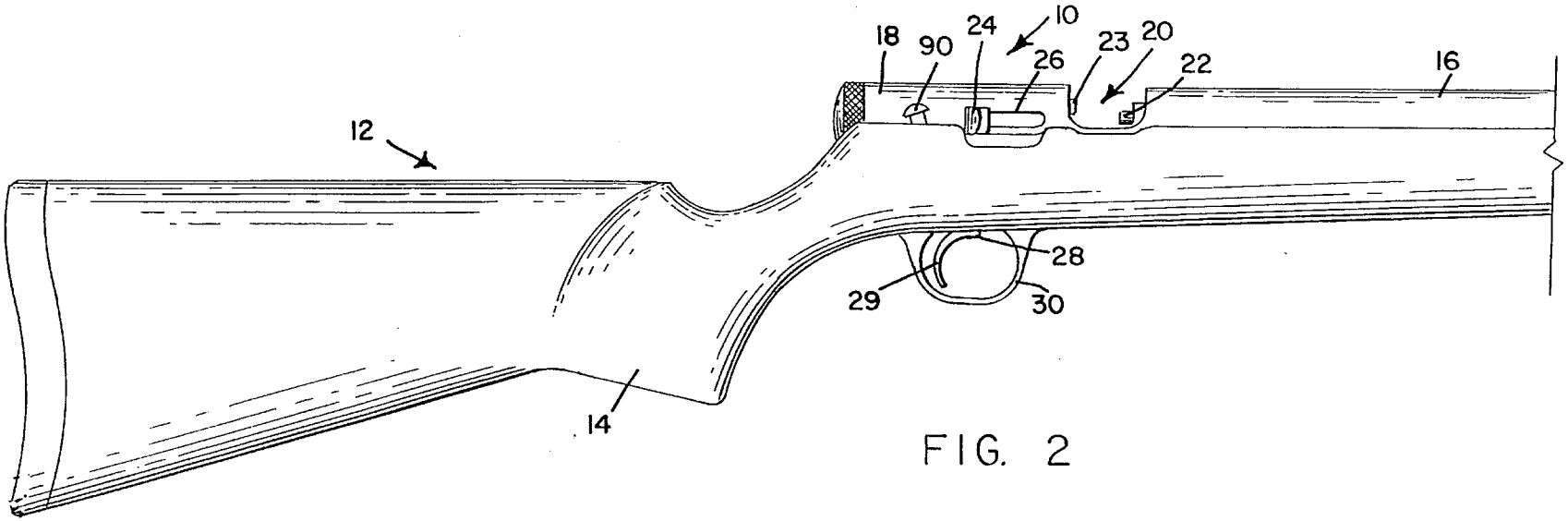
FIG. 2 is a right side elevational view of the firearm of FIG. 1.
Figure 3:
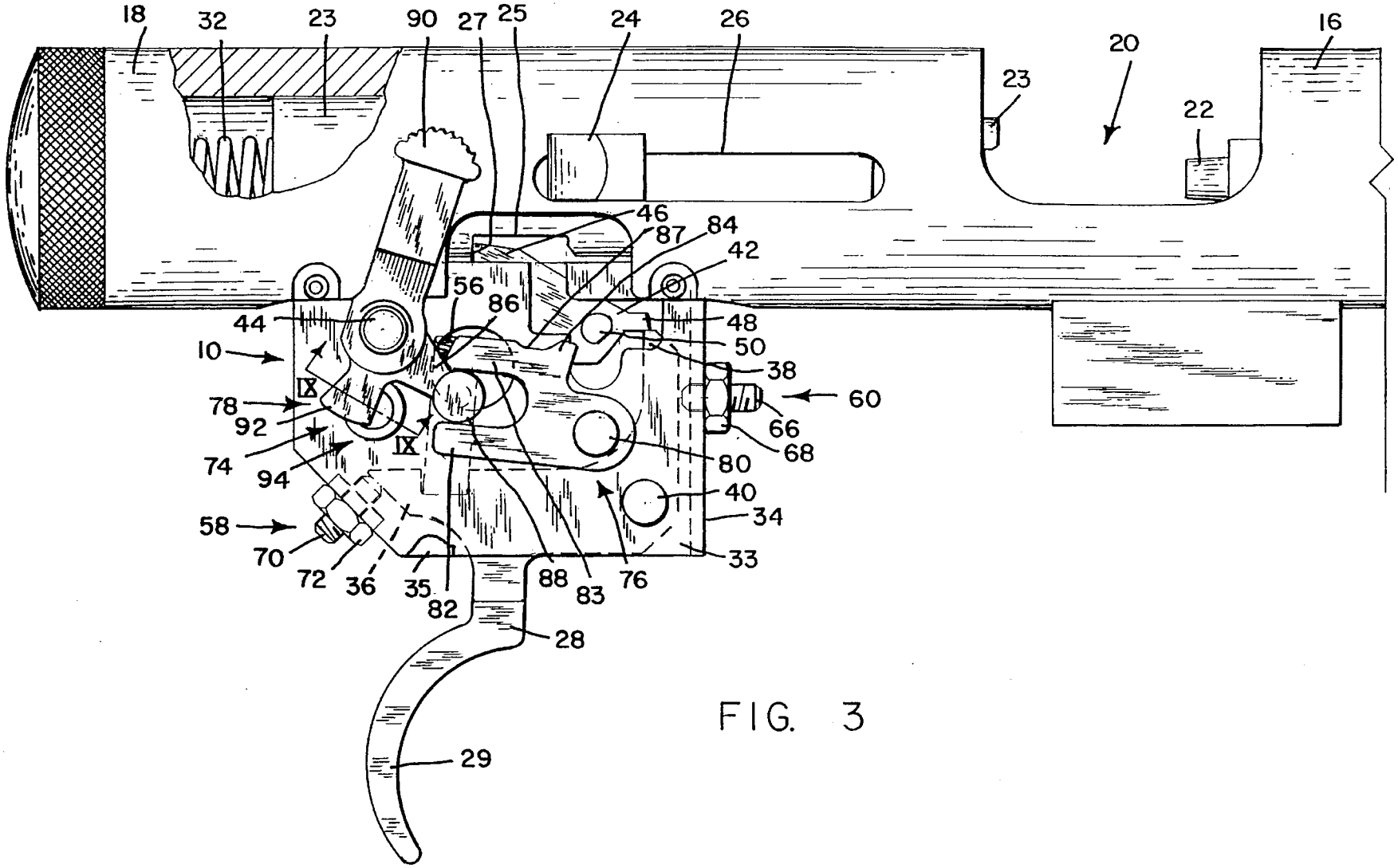
FIG. 3 is a side elevational view of the fire control mechanism of the present invention as applied to the breech portion of the firearm with the stock of the firearm removed, showing the striker in its cocked position and the locking mechanism in its inactive state.

Referring first to FIGS. 1 and 2 the fire control mechanism of the present invention, is generally indicated by the reference numeral 10, and is shown applied to a firearm which is generally indicated by the reference numeral 12. Firearm 12, by way of example, is a muzzle loading rifle which has a stock 14 and a barrel 16. The barrel 16 has a rear breech end 18 which contains a breech 20 for receiving a percussion cap 22. The breech end of the barrel also contains a striker or bolt 23 which is slidably mounted within the bore of the barrel at the breech end 18 between a rearward cocked position and a forward firing position. The bolt 23 is biased toward the forward firing position by a first relatively strong spring 32 which is shown in FIG. 3. The bolt 23 is moved from its firing position to the cocked position against the bias of spring 32 by a bolt actuator 24. The actuator 24 extends laterally from the bolt 23 through a horizontal slot 26 in the breech end of the barrel. The fire control mechanism also includes a trigger mechanism, generally indicated by the reference numeral 28. The trigger mechanism includes a downwardly extending trigger 29 which is located within a trigger guard 30.

Referring particularly to FIG. 3, the bottom of the bolt 23 has a slot 25 which extends transversely of the longitudinal axis of the bolt, the rear portion of the slot is defined by a forwardly facing vertical edge surface 27. The fire control mechanism 10 includes a trigger housing which is generally indicated by the reference numeral 34 and which comprises two flat vertical spaced plates 33 and 35. The plates 33 and 35 are connected by a vertical front wall 62 and downwardly and rearwardly facing rear wall 64, see FIG. 6. The trigger mechanism 28 which forms part of the fire control mechanism is pivotally mounted on a pin 40 which is supported between the plates 33 and 35. The trigger mechanism 28 is mounted for rotation about a first horizontal axis which extends through the center of the pin 40. The trigger mechanism 28 has a first rearwardly extending integral arm 36 and a second upwardly extending integral arm 38. A sear 42 is pivotally mounted on a pin 44 which extends horizontally between the two plates 33 and 35. The sear 42 is mounted for rotation about a second horizontal axis which extends through the center of pin 44. The sear 42 has an upper projection 46 and a forward projection 48.

Figure 5:
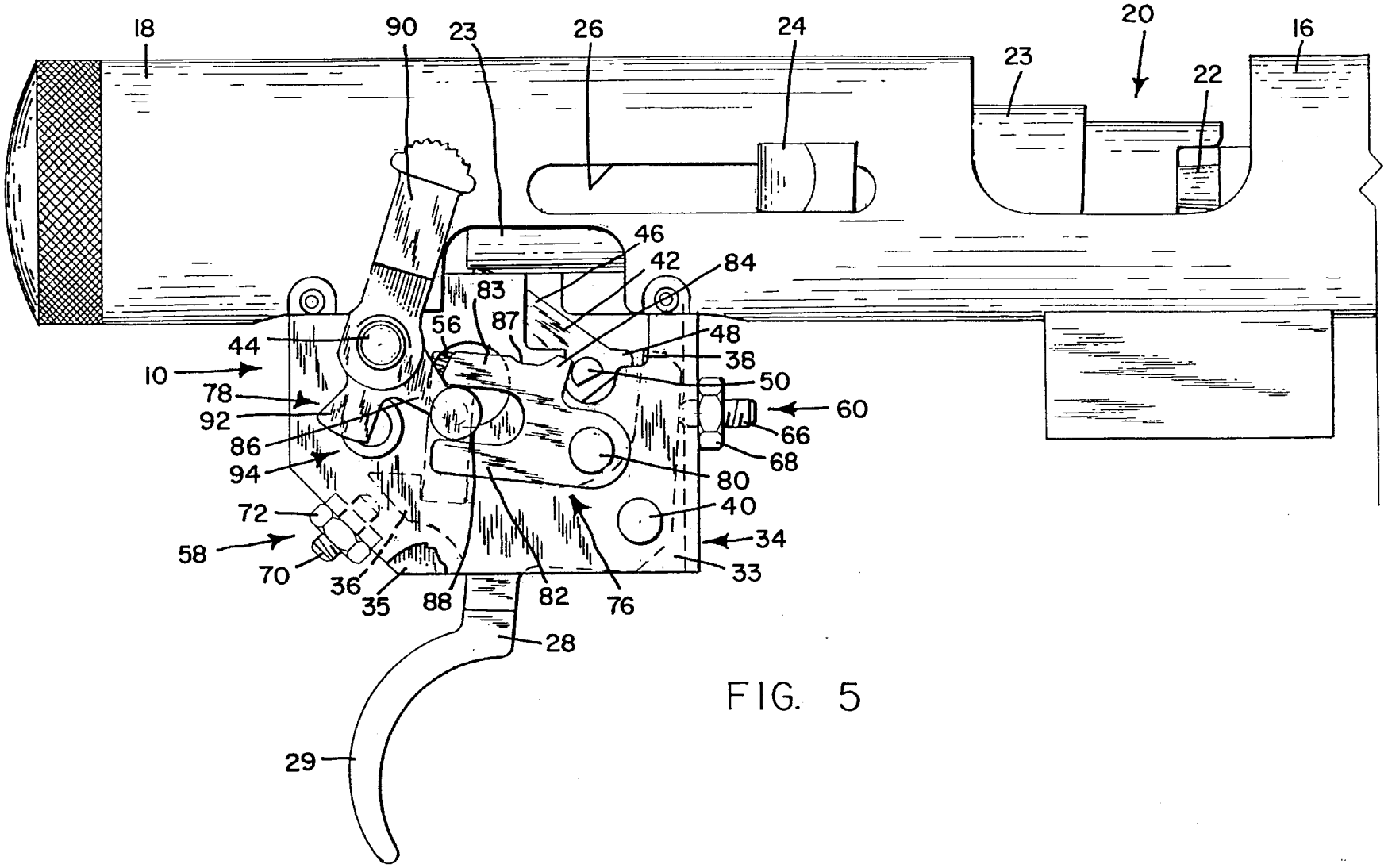
FIG. 5 is a view similar to FIGS. 3 and 4 showing the locking mechanism in its inactive state and the striker in its firing position.
Figure 6:
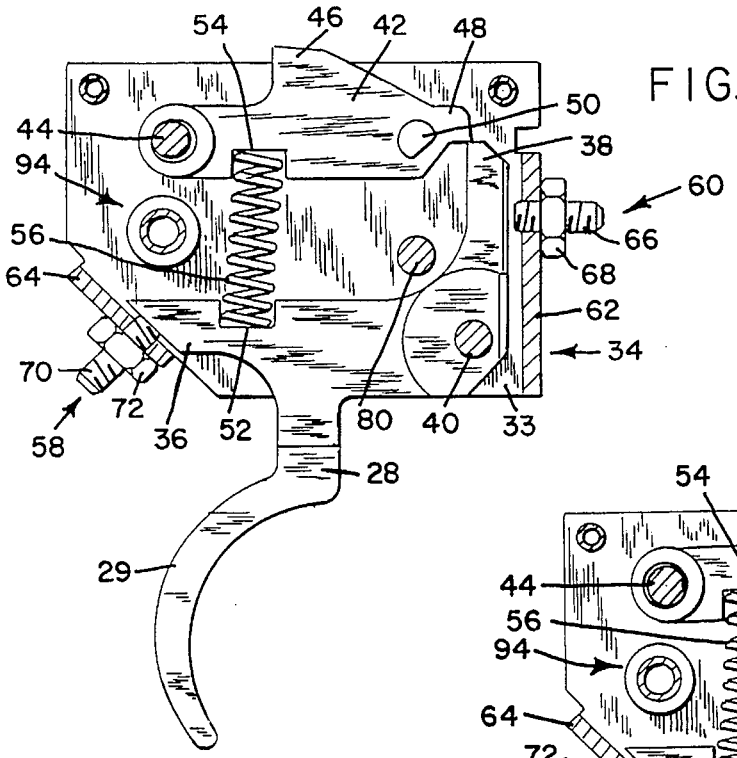
FIGS. 6–8 are fragmentary views of the relative positions of the sear and trigger and which correspond to FIGS. 3–5.
Figure 7:
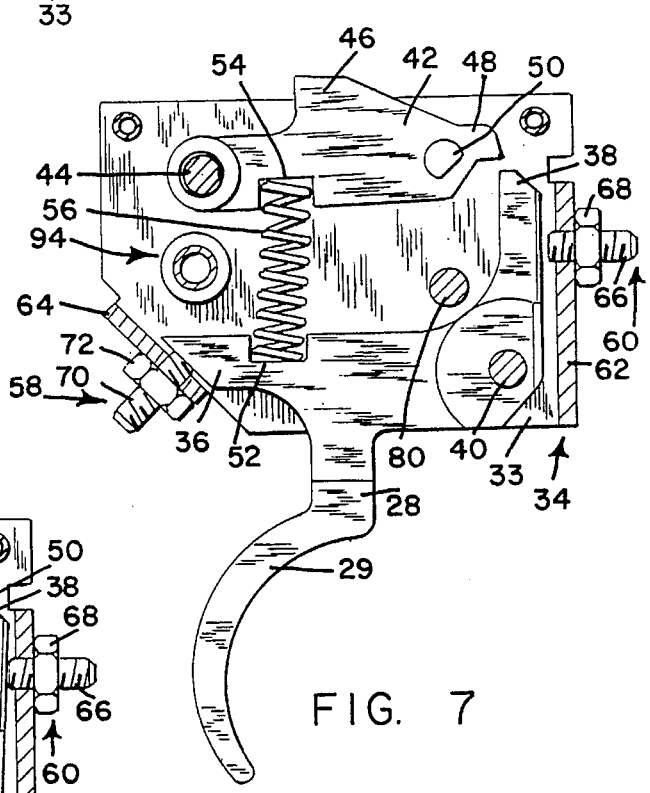
Figure 8:
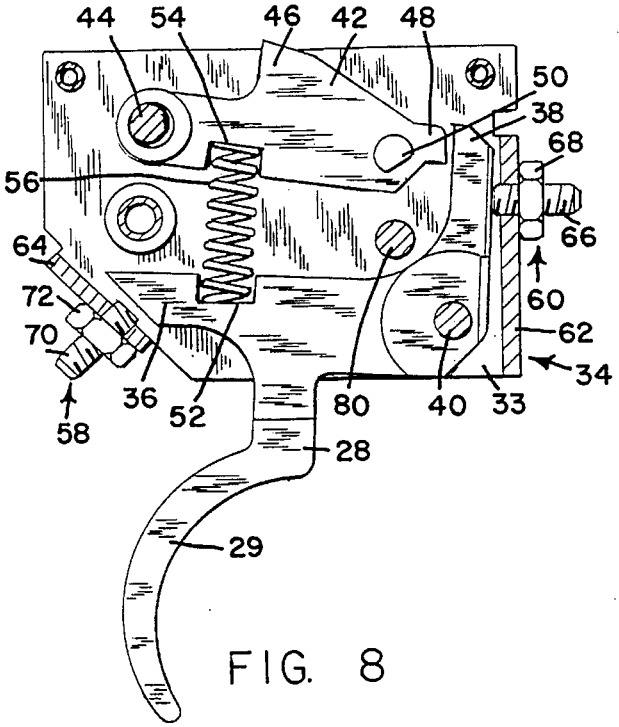

Referring particularly to FIGS. 6–8, the trigger mechanism 28 is mounted on the pin 40 for pivoting movement between a cocked position, as shown in FIG. 6, to a firing position, as shown in FIG. 8. The sear 42 is mounted on the pin 44 for pivoting movement between a striker holding position, as shown in FIG. 6, and a striker release position as shown in FIG. 8. The upper surface of the trigger mechanism 28 has a transverse notch 52 which is vertically aligned with a downwardly facing transverse notch 54 in the lower edge surface of the sear 42. A second relatively weak spring 56 extends from the notch 52 of the trigger mechanism 28 to the notch 54 of the sear 42 for biasing the trigger to its cocked position and for biasing the sear 42 to its striker release position. When the striker or bolt 23 is in its rearward cocked position, the spring 56 urges the rearwardly facing edge of the upper projection 46 against the forwardly facing surface 27 at the rear end of the notch 25. The spring 32 is strong enough to overcome the biasing force of the spring 56 and to bias the bolt 23 toward the firing position. However, the sear 42 is maintained in its cocked position by the integral arm 38 of the trigger mechanism 28 which supports the forward projection 48 of the sear 42, as shown in FIGS. 3 and 6. When the downwardly extending trigger 29 is pulled rearwardly, the trigger mechanism 28 is pivoted to its firing position, as shown in FIGS. 3 and 8. This effectively moves the second integral portion 38 of the trigger mechanism forwardly of the forward projection 48 of the sear so that the sear is no longer supported by the trigger. Without the support of the trigger, the sear 42 is pivoted to its striker release position by the biasing force of the relatively strong spring 32, as shown in FIGS. 5 and 8. This releases the striker or bolt 23 which is biased to its firing position by the spring 32, as shown in FIG: 5. This causes the forward end of the bolt 23 to strike the percussion nipple 22 and to discharge the firearm.

The cocked position of the trigger is determined by a rearward stop which is generally indicated by the reference numeral 58. The firing position of the trigger 28 is determined by a forward stop which is generally indicated by the reference numeral 60. The rearward stop 58 comprises a screw 70 which is threaded into the rear wall 64 and which extends through the wall 64 to engage the rearward edge of the arm 36 of the trigger mechanism 28. The outer end of the screw 70 has a hex socket for receiving an allen wrench. Screw 70 is maintained in its adjusted position by a lock nut 72. The forward stop 60 comprises a screw 66 which is threaded into the forward wall 62 and which extends beyond the wall 62 to be contacted by the forward edge of the arm 38 of the trigger when the trigger is pulled to its firing position, as shown in FIG. 8. The outer end of the screw 60 has the hex socket for receiving an allen wrench and is maintained in its adjusted position by a lock nut 68.

Figure 4:
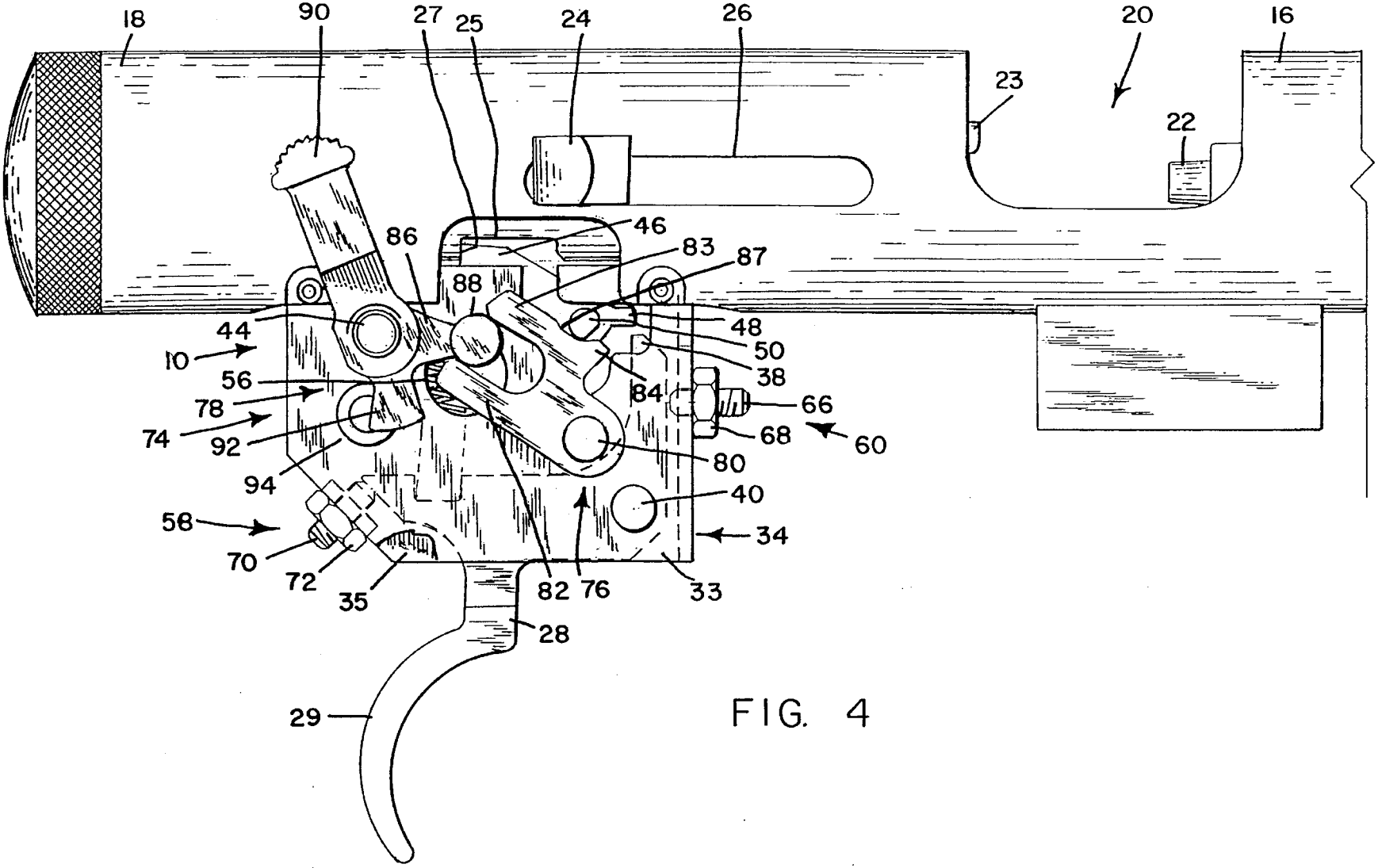
FIG. 4 is a view similar to FIG. 3 showing the striker in its cocked position and the locking mechanism in its active state.

Referring particularly to FIGS. 3–5, the fire control mechanism 10 of the present invention comprises a locking mechanism which is generally indicated by the reference numeral 74. The locking mechanism 74 include a lock which is generally indicated by the reference numeral 76 and a lock actuator which is generally indicated by the reference numeral 78. The lock 76 is mounted for pivoting movement about a third horizontal axis on a pivot pin 80 which is supported between the plates 33 and 35 of the trigger housing. The lock 76 has a pair rearwardly extending spaced arms 82 and 82 which form a yoke. The lock 86 has an upwardly extending projection 84 and a depression or seat 87 in the upper edge surface of the lock 76 between the projection 84 and the arm 83. The lock actuator 74 consists of a bell crank lever which includes a first arm 86. The forward end of the arm 86 has a circular surface 88 that extends between the arms 82 and 83 of the lock 76 and a second arm 90 which extends upwardly along one side of the barrel 16 for engagement by the user's finger. The actuator 78 is pivotally mounted on the pin 44 for movement between an unlocking position, as shown in FIG. 3, to a locking position, as shown in FIG. 4. The actuator 78 has a third arm 92 which extends downwardly for engaging a detent means which is generally indicated by the reference numeral 94. The inner surface of the arm 92 is V-shaped in cross-section, as shown in FIG. 9, for engaging the detent means 94.

Figure 9:
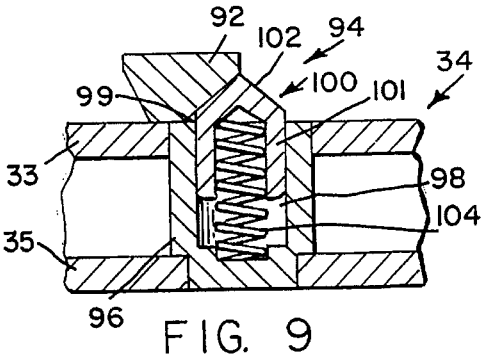
FIG. 9 is a vertical cross-sectional view of detent means for releasably holding an actuator which forms part of the locking mechanism in either of its two positions.

Referring particularly to FIG. 9, the detent means 94 includes a plug 96 which is fixed to the plates 33 and 35 and which contains a transverse horizontal bore 98 which has an opening 99 at the outer surface of the plate 33. A plunger, which is generally indicated by the reference numeral 100, is slidably mounted in the bore 98 for movement along the central longitudinal axis of the bore. The plunger 100 includes a cylindrical portion 101 which is located within the bore 98 and a conical portion 102 which extends through the opening 99 and lies outside of the outer surface of the plate 33. The plunger 100 is biased toward the outer position by a spring 104. The conical portion 102 is engaged by the bottom surface of the arm 92 when the actuator 78 is moved from the unlocking position, as shown in FIG. 3, to the locking position, as shown in FIG. 4 and when the actuator 78 is pivoted from the locking position to the unlocking position. The detent means 94 helps to maintain the actuator 78 in either of its locking and unlocking positions, since the movement of the actuator from one of its positions to the other of its positions the arm 92 must depress the plunger 100 against the bias of the spring 104 when moving from one of its positions to the other of its positions.

The firearm 10 is utilized by first loading the barrel 16 with powder, projectile and appropriate wadding and applying a percussion cap or nipple 22 in the breech 20. The bolt 23 is brought to the cocked position, as shown in FIG. 3, by pulling the actuator 24 rearwardly along the slot 26 until it reaches the position shown in FIG. 3. In this position, the notch 25 is vertically aligned with the upper projection 46 of the sear. The sear 42 is biased upwardly by the spring 56 so that the upper projection 46 of the sear extends into the notch 25 and bears against the forwardly facing lower edge surface 27 which defines the rearward end of the notch 25. The spring 56 also biases the trigger 28 to the cocked position so that it lies beneath the forward projection 48 of the sear. This prevents the sear from being rotated clockwise as viewed in FIG. 3 about the pivot pin 44 by the spring 32 and maintains the bolt 23 in the cocked position.

The locking mechanism 74 is actuated by pulling the arm 90 rearwardly. This causes the actuator 78 to rotate counter clockwise, as viewed in FIG. 3, around the pivot pin 44 to the locking position, shown in FIG. 4. This causes the arm 86 of the actuator to rotate the lock 76 about the pivot pin 80 in a clockwise position, as viewed in FIGS. 3 and 4, to the locked position shown in FIG. 4. When the lock 76 is in the locked position, the seat 87 engages the laterally extending projection 50 of the sear and causes the sear to rotate a relatively small amount about the pivot pin 44 in a counter clockwise direction, as viewed in FIG. 4. The small rotation of the sear 42 moves the upper projection 46 upwardly and rearwardly. Since the projection impinges on the forwardly facing surface 27, the bolt 23 is moved rearwardly a small amount. The small movement of the sear also disengages the forward projection 48 of the sear from the second integral arm 38 of the trigger, as shown in FIG. 4. Since the sear 42 is immobilized by the lock 76, it will continue to hold the bolt 23 in its cocked position to prevent discharge of the firearm even if the trigger 29 is pulled to the firing position. The projection 50 of the sear moves along an are which passes very close to the axis of the pin 80 which supports the lock 76. The lock 76 is prevented from being rotated by the detent means 94 which acts directly on the arm 92 of the actuator 78. This resistance to motion is multiplied by the mechanical advantage which is developed by the compound levers which are represented by arms 86 and arms 82 and 83 as opposed to the extremely short lever arm which is represented by the distance between the arc of movement of the projection 50 and to the horizontal axis of the pin 80. The force which would be required to move the lock 76 from its locking position in FIG. 4 to its unlocked position in FIG. 3 by the impingement of the projection 50 on the seat 87 is far greater than the biasing force which is generated by the spring 32.

When the user wishes to discharge the firearm 12, the lock 76 is rotated back to its unlocked position by moving the arm 90 forwardly, as shown in FIG. 3. This enables the sear to return to its normal striker holding position wherein the projection 48 rests on the upper edge surface of the arm 38 of the trigger mechanism 28, as shown in FIG. 3. The firearm can then be discharged by pulling the downwardly extending trigger 29 of the trigger mechanism rearwardly. This causes the trigger mechanism 28 to rotate about the pivot pin 40 in a clockwise position, as shown in FIG. 3, so that the arm 38 of the trigger mechanism moves forwardly, as shown in FIG. 5. The forward movement of the arm 38 of the trigger mechanism places the top edge surface of the arm 38 forward of the projection 48 of the sear. Since the projection 48 of the sear is no longer supported by the arm 38 of the trigger mechanism and since the spring 32 is considerably stronger than the spring 56, the sear is caused to rotate in a clockwise direction, as shown in FIG. 5, by the biasing force of the spring 32, acting through the bolt 23. As the projection 48 moves downwardly behind the arm 38, the projection 46 of the sear 42 moves downwardly below the bolt 23. This releases the bolt 23 to its forward discharge position, as shown in FIG. 5. When the bolt 23 reaches its forward position, it strikes the percussion nipple 22 which ignites the powder charge in the firearm and discharges the firearm.

It is clear that minor changes may be made in the form and construction of the invention without departing from the materials spirit thereof. It is not, however, confine the invention to the exact form herein shown in described but it is desired to include all such is properly come within the scope claimed.

The invention having been thus described, what is claimed is new and desired to secure by Letters Patent is:

1. In a firearm having a barrel which a muzzle end and a breech end and a bore, the firearm also including a striker which has a downwardly facing notch and a forwardly facing lower edge surface which defines the rear edge of the notch, the striker being slidably mounted in the breech end of the barrel for movement between a rearward cocked position and a forward firing position, a striker spring for biasing the striker toward the firing position, and a striker actuator for moving the actuator to the rearward cocked position against the bias of the striker spring, a fire control mechanism comprising:

(a) a trigger housing which is fixed to the breech end of the barrel;

(b) a trigger which is mounted on the housing for pivoting movement about a first horizontal axis between a cocked position and a firing position, said trigger having an upwardly facing edge surface;

(c) a sear which is mounted on the housing for pivoting movement about a second horizontal axis between a striker holding position and a striker release position, said sear having an upper projection for entering said notch and engaging said forwardly facing edge surface when said striker is in its rearward cocked position and said sear is in its striker holding position, said sear having a forward projection for engaging the upwardly facing edge surface of said trigger when said sear is in its striker holding position and said trigger is in its cocked position to prevent said striker from being moved to its tiring position by said striker spring, said forward projection being out of engagement with said upwardly facing edge surface when said trigger is its firing position to enable said striker to be moved to its firing position by said striker spring;

(d) biasing means for biasing said trigger to its cocked position and said sear to its striker holding position, said biasing means being substantially weaker than said striker spring so that when said trigger is moved to its firing position, said sear is moved to its striker release position by said striker under the biasing influence of said striker spring to release the striker to its firing position under the biasing influence of said striker spring; and (e) a locking mechanism which is mounted on said trigger housing for selective actuation between an active state and an inactive state, said locking mechanism being effective in its active state to engage said sear and prevent said sear from being moved to its striker release position by said striker when said trigger is moved to its firing position and to allow said sear to be moved to its striker release position when said trigger is moved to its firing position and said locking mechanism is in its inactive state, said locking mechanism comprising:

(1) a laterally extending projection which is fixed to said sear;

(2) a lock which is mounted on said trigger housing for movement between a locking position in which a portion of said lock obstructs said laterally extending projection to prevent said sear from moving to its firing position and a release position in which said sear is free to move to its firing position; and (3) an actuator for selectively moving said lock to said locking position and to said release position.

2. In a firearm as recited in claim 1, wherein said lock is a lever which is mounted on said trigger housing for pivoting movement about a third horizontal axis and said actuator is a bell crank lever which is pivotally connected to said trigger housing, said bell crank lever having a first arm which is operatively connected to said lock and a second arm for engagement by a user's finger.

3. In a firearm as recited in claim 2, wherein the connection between said first arm and said lock is a yoke connection.

4. In a firearm as recited in claim 2, wherein said bell crank lever has a third arm and said locking mechanism further comprises detent means which is operatively connected to said trigger housing and to said third arm to yieldingly maintain said lock in either of its locking and release positions.

5. In a firearm as recited in claim 2, wherein the laterally extending projection of said sear moves along an arc which is relatively close to said third horizontal and the portion of said lock which obstructs said laterally extending projection is located between said laterally extending projection and said third horizontal axis when said lock is in the locking position.

6. In a firearm as recited in claim 2, wherein said biasing means is a spring which engages said trigger and said sear for biasing said trigger to its cocked position and for biasing said sear to said striker holding position.

7. In a firearm as recited in claim 2, wherein said actuator is mounted for rotation about said second horizontal axis.

8. In a firearm as recited in claim 1, wherein said locking mechanism further comprises detent means for yieldingly maintaining said lock in either of its locking and release positions.

* * * * *